US009601885B2

(12) United States Patent
Fransen

(10) Patent No.: US 9,601,885 B2
(45) Date of Patent: Mar. 21, 2017

(54) GG45 PLUG WITH HINGING LOAD BAR

(71) Applicant: Panduit Corp., Tinley Park, IL (US)

(72) Inventor: Robert E. Fransen, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/713,321

(22) Filed: May 15, 2015

(65) Prior Publication Data

US 2015/0263466 A1 Sep. 17, 2015

Related U.S. Application Data

(63) Continuation of application No. 13/864,924, filed on Apr. 17, 2013, now Pat. No. 9,033,725.

(60) Provisional application No. 61/635,669, filed on Apr. 19, 2012.

(51) Int. Cl.

| | |
|---|---|
| ***H01R 4/50*** | (2006.01) |
| ***H01R 13/625*** | (2006.01) |
| ***H01R 24/64*** | (2011.01) |
| ***H01R 13/6461*** | (2011.01) |
| ***H01R 4/24*** | (2006.01) |
| ***H01R 13/50*** | (2006.01) |
| ***H01R 24/28*** | (2011.01) |
| ***H01R 13/6585*** | (2011.01) |
| *H01R 107/00* | (2006.01) |

(52) U.S. Cl.

CPC ..... *H01R 24/64* (2013.01); *H01R 4/2433* (2013.01); *H01R 13/501* (2013.01); *H01R 13/6461* (2013.01); *H01R 13/6585* (2013.01); *H01R 24/28* (2013.01); *H01R 2107/00* (2013.01)

(58) Field of Classification Search

CPC . H01R 4/2412; H01R 13/516; H01R 13/5213
USPC ..... 439/344, 367, 409, 410
See application file for complete search history.

(56) References Cited

U.S. PATENT DOCUMENTS

| | | | | |
|---|---|---|---|---|
| 5,240,436 | A * | 8/1993 | Bradley | H01R 13/516 439/620.1 |
| 5,372,513 | A | 12/1994 | Rodrigues et al. | |
| 5,571,035 | A | 11/1996 | Ferrill | |
| 5,954,542 | A * | 9/1999 | Wu | H01R 13/516 439/584 |
| 6,238,246 | B1 | 5/2001 | Ferrill et al. | |
| 6,250,949 | B1 * | 6/2001 | Lin | H01R 13/6272 439/344 |
| 6,287,149 | B1 | 9/2001 | Elkhatib et al. | |
| 6,328,601 | B1 | 12/2001 | Yip et al. | |
| 6,358,091 | B1 | 3/2002 | Lo et al. | |
| 6,629,858 | B2 | 10/2003 | Lo et al. | |
| 6,682,363 | B1 | 1/2004 | Chang et al. | |

(Continued)

FOREIGN PATENT DOCUMENTS

| | | |
|---|---|---|
| EP | 1892801 A1 | 2/2008 |
| WO | 2008071917 A1 | 6/2008 |

*Primary Examiner* — Hae Moon Hyeon
(74) *Attorney, Agent, or Firm* — Christopher S. Clancy; James H. Williams; Yuri Astvatsaturov

(57) ABSTRACT

A communication plug is described. The communication plug can have a load bar, a housing, and a divider. The load bar has a first half with first conductor receiving apertures and a second half with second conductor receiving apertures with a hinge connecting the first half and the second half. The load bar folds around the divider and then is inserted into the housing.

27 Claims, 11 Drawing Sheets

(56) References Cited

U.S. PATENT DOCUMENTS

| | | | | |
|---|---|---|---|---|
| 6,702,617 | B1 | 3/2004 | Clement et al. | |
| 6,811,445 | B2 | 11/2004 | Caveney et al. | |
| 7,134,914 | B1 * | 11/2006 | Wu | H01R 13/5804 439/357 |
| 7,220,149 | B2 * | 5/2007 | Pharney | H01R 13/6467 439/676 |
| 7,329,137 | B2 | 2/2008 | Martin et al. | |
| 7,413,464 | B1 | 8/2008 | Chen | |
| 7,435,142 | B1 * | 10/2008 | Hsu | H01R 13/506 439/676 |
| 7,686,650 | B2 | 3/2010 | Belopolsky et al. | |
| 7,736,159 | B1 * | 6/2010 | Effinger, III | H01R 24/86 439/108 |
| 7,753,717 | B2 * | 7/2010 | Belopolsky | H01R 9/032 439/418 |
| 7,857,635 | B2 * | 12/2010 | Goodrich | H01R 4/2412 439/344 |
| 7,918,684 | B2 | 4/2011 | Lu | |
| 7,972,150 | B1 | 7/2011 | Lin | |
| 8,038,461 | B2 | 10/2011 | Hsu | |
| 8,096,833 | B2 | 1/2012 | Tobey | |
| 8,764,471 | B2 * | 7/2014 | Dang | H01R 13/6463 439/310 |
| 8,858,267 | B2 * | 10/2014 | Hashim | H01R 13/6466 439/676 |
| 9,033,725 | B2 * | 5/2015 | Fransen | H01R 13/6461 439/344 |
| 2007/0270044 | A1 | 11/2007 | Belopolsky et al. | |
| 2011/0212652 | A1 | 9/2011 | Schmidt et al. | |
| 2012/0088395 | A1 | 4/2012 | Feldner et al. | |

* cited by examiner

GG45 PLUG WITH HINGING LOAD BAR

CROSS REFERENCE TO RELATED APPLICATIONS

This application is a continuation of U.S. patent application Ser. No. 13/864,924, filed Apr. 17, 2013, which claims priority to U.S. Provisional Patent Application No. 61/635,669, filed Apr. 19, 2012 and is incorporated by reference in its entirety.

BACKGROUND OF THE INVENTION

With the steady increase of users adopting 10GBASE-T Ethernet for areas such as high performance computing (HPC), storage area networks (SANs), and cloud computing, there is a need for an even greater increase data rates in the network backbone. The highest established data transmission rate for structured copper cabling is currently 10 Gigabits per second (Gps) running on Category 6A (CAT6A) cabling. Additionally, pointtopoint copper cabling solutions can run through a 40 Gps Quad Small Formfactor Pluggable (QSFP) connector via twinaxial copper cable. Unfortunately the QSFP connectivity comes with multiple drawbacks where one of the deficiencies is the maximum distance of 7 meters while the lengths used for HPC can be up to 50 meters. Other drawbacks of QSFP connectivity are that it is not backwards compatible with RJ45 connectivity, and does not currently support structured cabling.

Because of the split pair (pair 3-6 as defined by ANSI/TIA-568-C.2) in RJ45 connectivity and because of current practical modulation techniques, RJ45 connectivity is not currently capable of reaching higher data rates beyond 10 Gps. One of the problems with RJ45 connectivity is the inability to mitigate nearend crosstalk (NEXT) at frequencies above 500 MHz (for example, 2 GHz) where the current materials and crosstalk compensation techniques are some of the limiting factors. Another issue with RJ45 connectivity is the high level of signal reflection due to the split pair geometry in the RJ45 plug which causes high loss in the data transmitted in the frequencies beyond 500 MHz. Because of the inability for the RJ45 interface to operate effectively at frequencies above 500 MHz, the International Electrotechnical Commission (IEC) developed the IEC 60603-7-7 and 60603-7-71 standard for Category 7 and 7A connectivity. This standard defines a new connector interface, commonly referred to as GG45, where the jack supports a bandwidth greater than 500 MHz (600 MHz for Category 7 and 1000 MHz for Category 7A), while also having backwards compatibility to accept an RJ45 plug. U.S. Provisional Patent Application No. 61/543,866, titled "Backward Compatible Connectivity for High Data Rate Applications", filed Oct. 6, 2011, which is herein incorporated by reference in its entirety, describes such a jack that is compliant with the IEC 60603-7-7 standard. The plug defined in the IEC 60603-7-7 standard differs from an RJ45 plug in that the four conductor pairs are separated into four quadrants, eliminating the 3-6 split pair that limits the bandwidth of the RJ45 solution.

DESCRIPTION OF THE INVENTION

In one embodiment, the present invention is a plug compliant with IEC 60603-7-7 (hereby referred to as GG45 plug) and has the ability to operate at frequencies above 500 MHz for use in higher data rates future applications (ex. 40GBASE-T).

Figure 1:
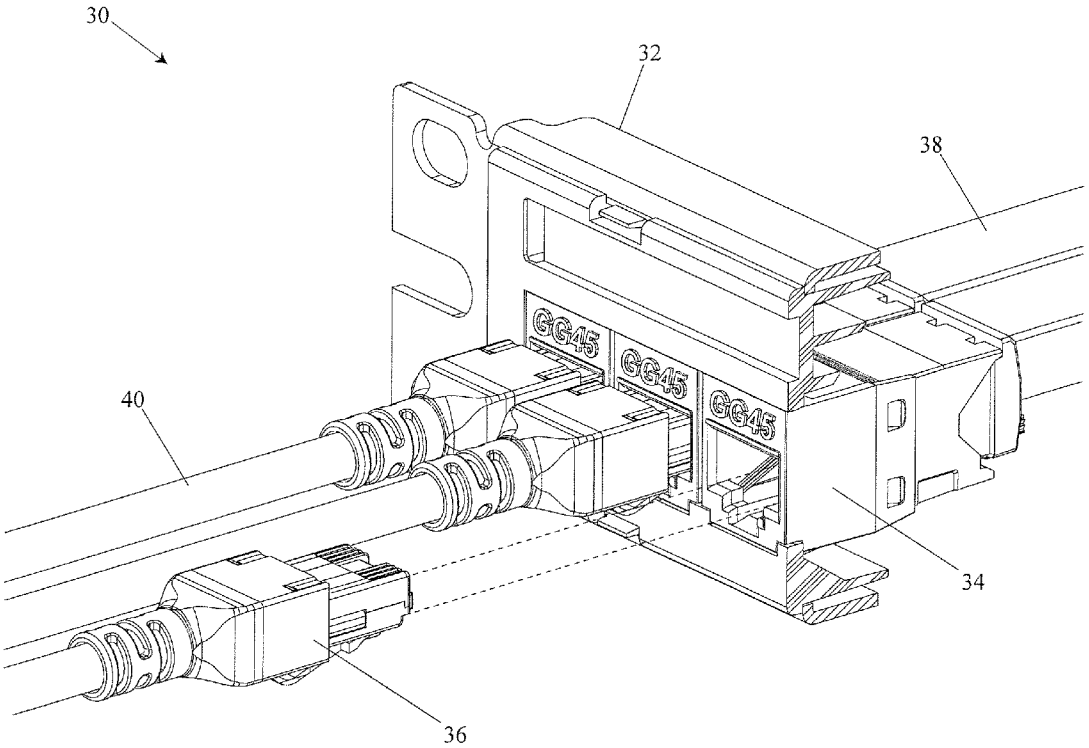
FIG. 1 is a perspective view of a communication system using a plug according to an embodiment of a present invention.

FIG. 1 illustrates a copper structured cabling communication system 30 which includes a patch panel 32 with GG45 jacks 34 and corresponding GG45 plugs 36. Respective cables 38 are terminated to GG45 jacks 34, and respective S/FTP cables 40 are terminated to GG45 plugs 36. Once a GG45 plug 36 mates with a GG45 jack 34 data can flow in both directions through these connectors.

Figure 2:
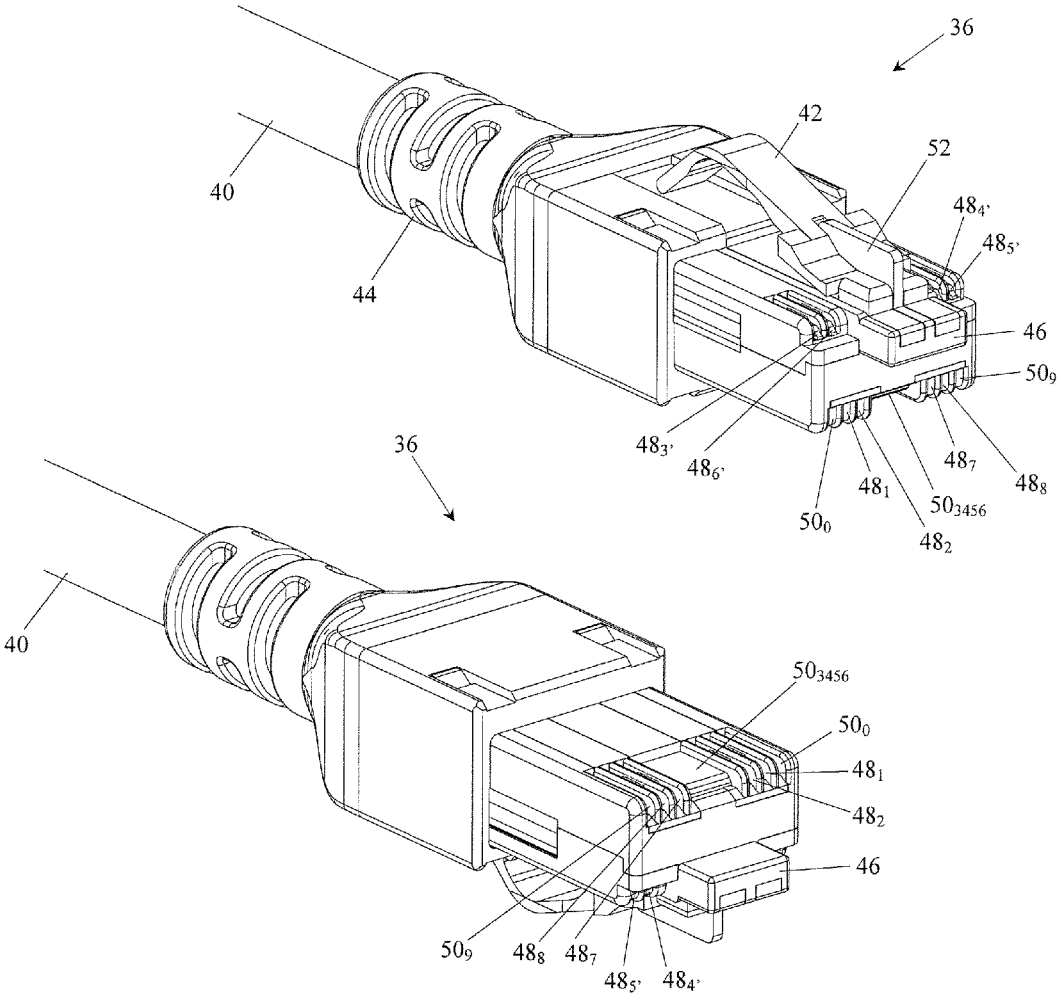
FIG. 2 includes top and bottom front isometric views of the plug of FIG. 1.

Referring now to FIG. 2, GG45 plug 36 can include a plug release latch 42 that engages and locks GG45 plug 36 to GG45 jack 34. Boot 44 can be used to constrain cable 40 so that it does not bend less than a minimum bend radius for S/FTP cable 40 exiting GG45 plug 36. Front nose element 46 is a feature defined by IEC 60603-7-7 and is used to toggle a switching mechanism inside of GG45 jack 34. A traditional RJ45 plug does not have a feature like front nose element 46 of GG45 plug 36. Therefore when an RJ45 plug is inserted into GG45 jack 34, the switching mechanism is not toggled. When GG45 plug 36 is inserted into GG45 jack 34, however, front nose element 46 toggles the switching mechanism so that GG45 jack 34 is converted to its alternate mode of operation capable of supporting frequencies above 500 MHz. U.S. Provisional Patent Application No. 61/543,866 contains more detail on an embodiment of a switching mechanism and two modes of operation for GG45 jack 34.

GG45 plug 36 contains eight transmission paths 48. The subscript numerals after 48 in FIG. 2 indicate the signal pin out as defined by IEC 60603-7-7 . Grounding pads 50 are present to bond to unneeded plug interface contacts (PICs) of GG45 jack 34 and bring them to ground. Grounding pad $50_{3456}$ grounds PICs 3, 4, 5, and 6 of GG45 jack 34 as these PICs are only used during RJ45 mode of operation and are unused at frequencies above 500 MHz. Additionally, grounding pads $\mathbf{50}_0$ and $\mathbf{50}_9$ are present to ground PICs 0 and 9 of GG45 jacks 34 should they exist. It may be advantageous to include PICs 0 and 9 in GG45 jack 34 in order to achieve as much of a balanced design as possible. For example, transmission paths $\mathbf{48}_7$ and $\mathbf{48}_8$ represent a transmission pair. When PIC 6 is grounded by grounding pad $\mathbf{50}_{3456}$, transmission path 487 has a ground running parallel adjacent in the form of PIC 6. If there is no grounded PIC 9 running parallel adjacent to transmission path $\mathbf{48}_8$, then the system may become unbalanced. The same holds true for transmission paths $\mathbf{48}_1$ and $\mathbf{48}_2$. Therefore, in one embodiment, GG45 plug 36 can have grounding pads $\mathbf{50}_0$ and $\mathbf{50}_9$ as provisions for a highly balanced system that may extend into GG45 jack 34. GG45 plug 36 can also have dividing wall 52 which reduces crosstalk between signal transmission pair $\mathbf{48}_{3'}$ and $\mathbf{48}_{6'}$ and signal transmission pair $\mathbf{48}_{4'}$ and $\mathbf{48}_{5'}$.

Figure 3:
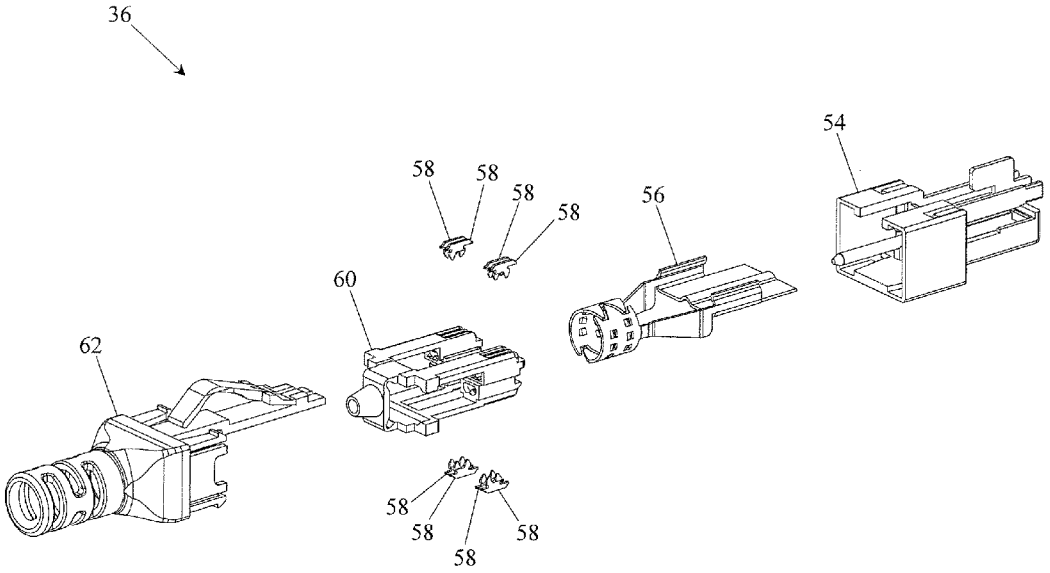
FIG. 3 is an exploded perspective view of the plug of FIG. 2.

Signal transmission paths for conductors 1, 2, 7, and 8 are in the same locations for both GG45 plug 36 and a standard RJ45 plug. Numerals with a prime, specifically 3', 4', 5', and 6', are unique to the GG45 interface and are not present in RJ45 plugs and jacks. An exploded view of GG45 plug 36 is shown in FIG. 3. GG45 plug 36 may contain plug housing 54 (which may be metal die cast for example), divider 56 (which may be a sheet metal part), eight plug insulation piercing contacts (IPCs) 58, hinging load bar 60, and plastic back housing 62.

Figure 4:
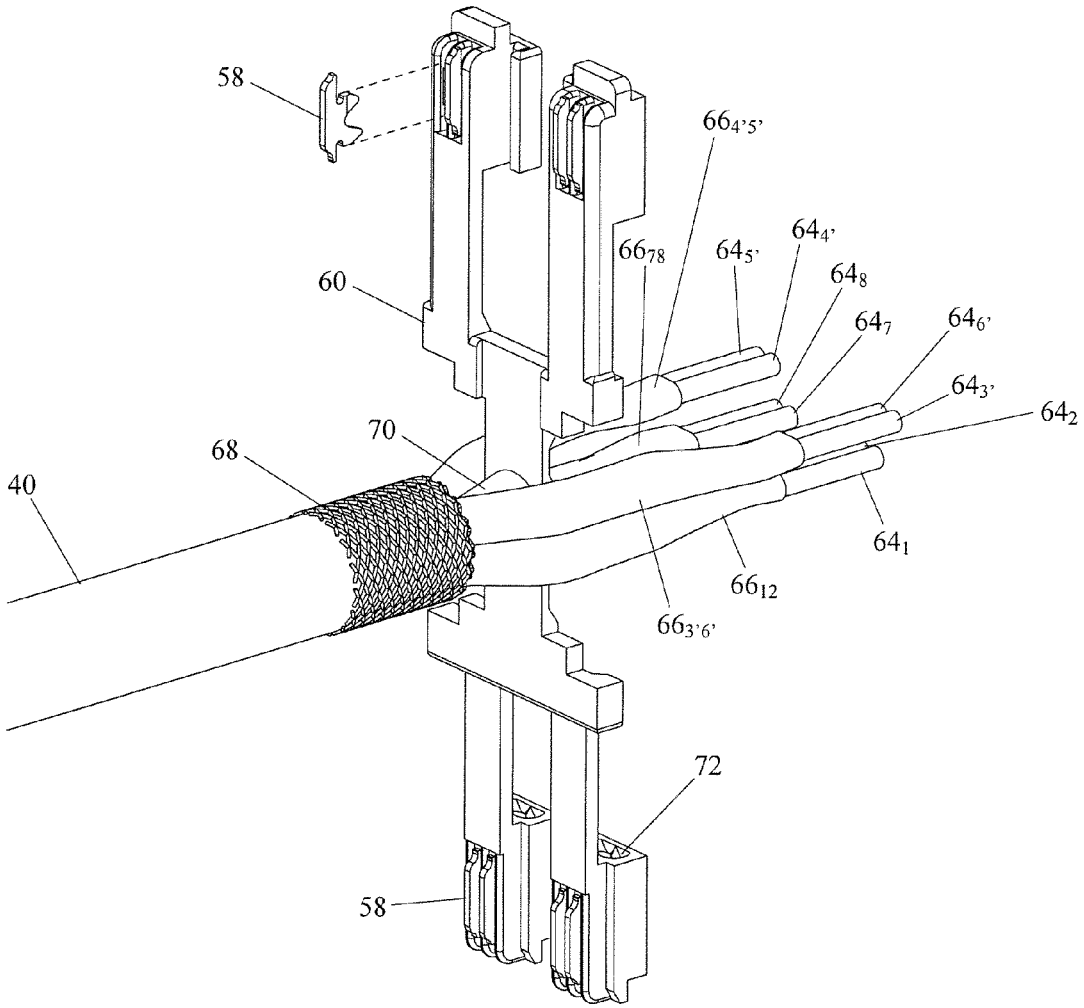
FIG. 4 is a perspective view showing the hinging load bar of the plug of FIG. 2 in an open position before the conductors of a twisted pair cable are inserted into their respective load bar holes.

To terminate STIP cable 40 to GG45 plug 36, S/FTP cable 40 must be prepped as shown in FIG. 4. Hinging load bar 60 can be molded in an open orientation. Plug contacts 58 can be stitched into hinging load bar 60 only so deep as to not fall out. Conductors 64 are arranged according to their signal transmission pin out as defined by IEC 6060377 and cut to a prescribed length. Additionally, conductive foil 66 that surrounds each signal transmission pair of conductors 64 must be trimmed as shown in FIG. 4. Braid 68 of shielded/foiled twisted pair (S/FTP) cable 40 is rolled back and trimmed to the appropriate length. Hinging load bar 60 can be positioned between the four pairs of conductors. Conical guide element 70 aids in the positioning of hinging load bar 60 relative to S/FTP cable 40.

Figure 5:
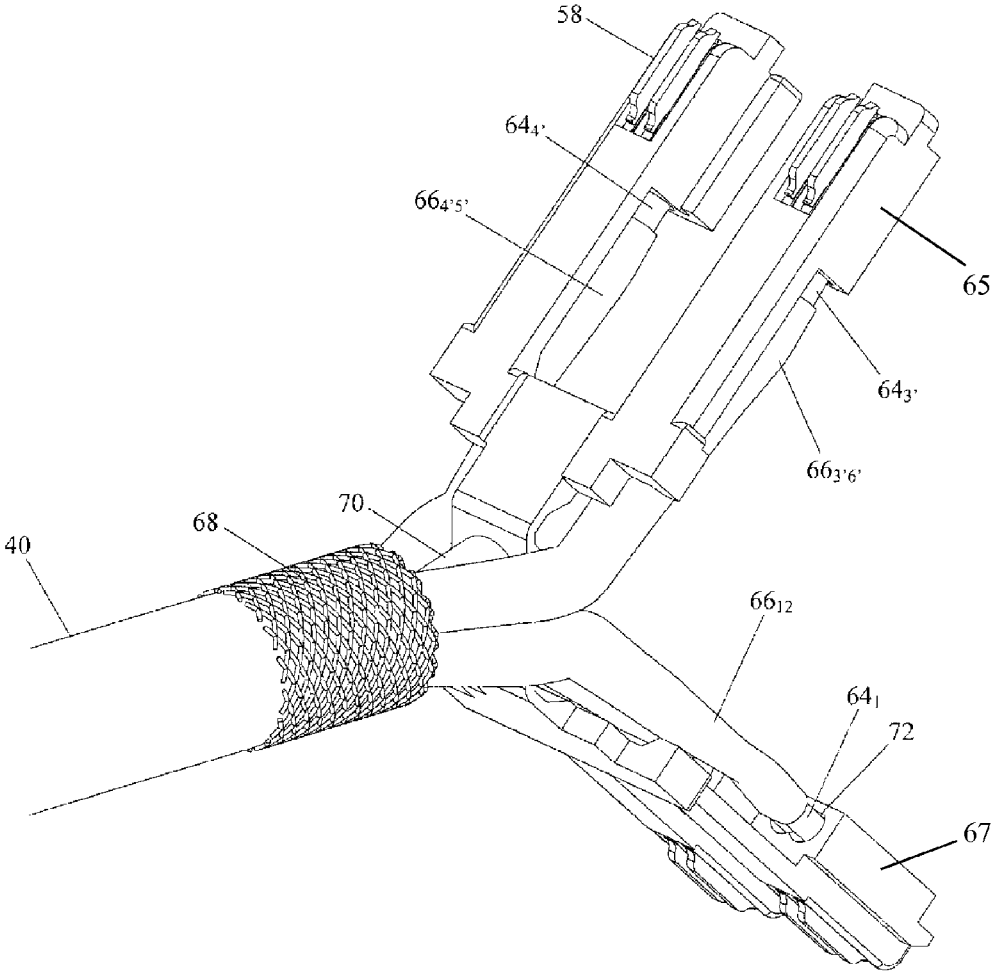
FIG. 5 is a perspective view showing the hinging load bar of FIG. 4 still in the open position but with the conductors of the cable inserted into their respective load bar holes.
Figure 6:
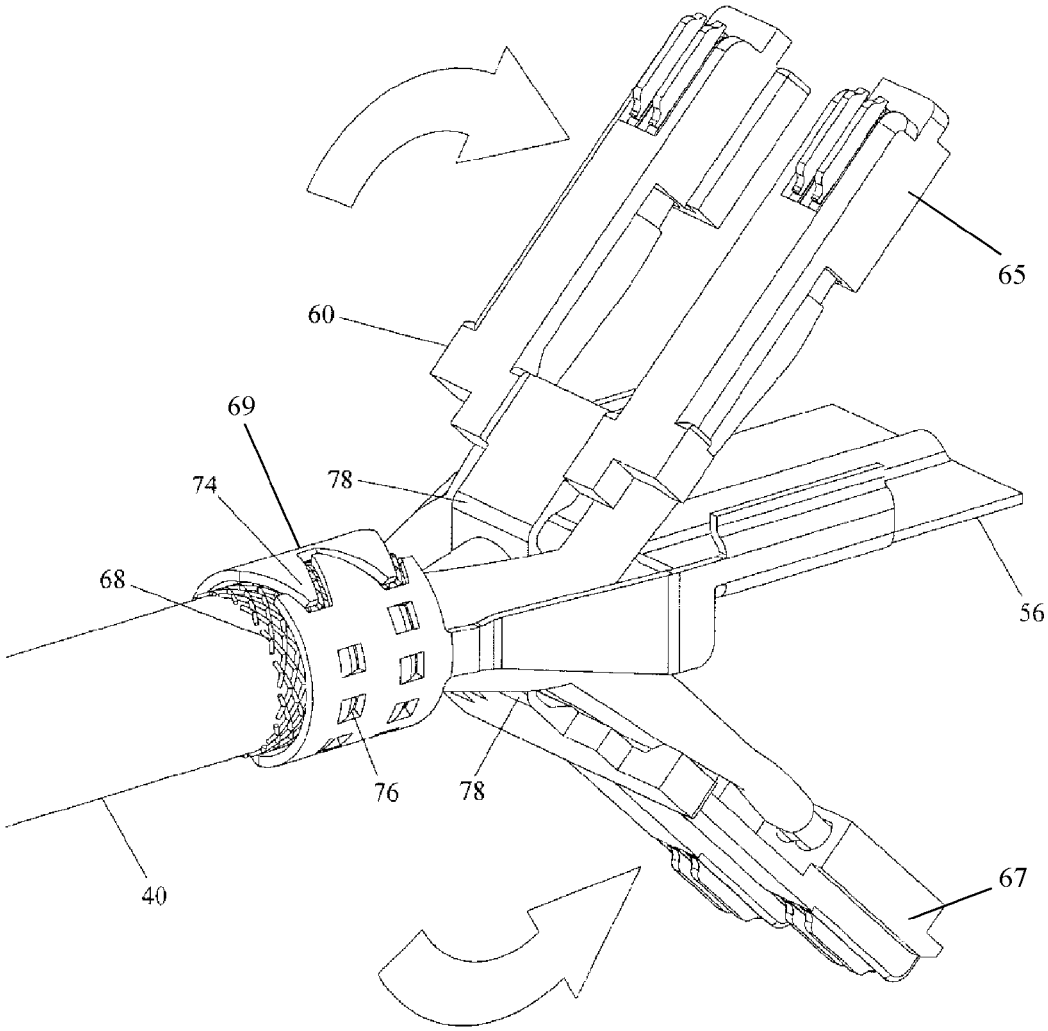
FIG. 6 is a perspective view of the subassembly of FIG. 5 collapsing around the metal divider.
Figure 7:
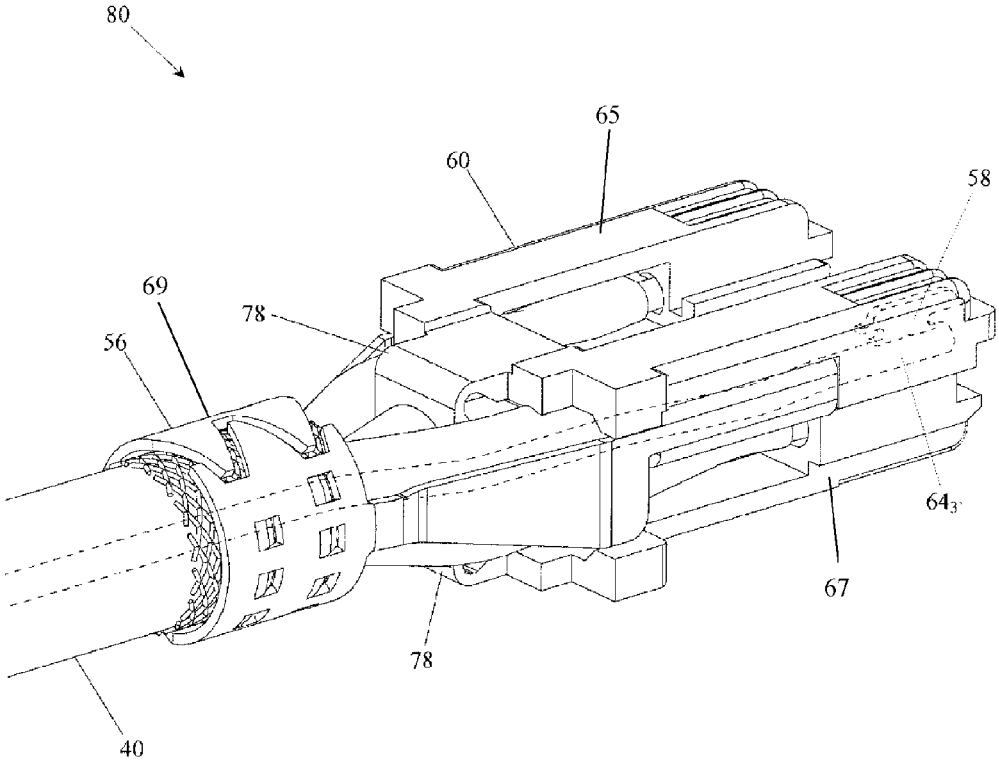
FIG. 7 is a perspective view of the subassembly of FIG. 6 with the conductors of the cable inserted into their respective holes of the hinging load bar and the hinging load bar collapsed around the metal divider.

With S/FTP cable 40 prepped and hinging load bar 60 together with its first half 65 and second half 67 in its proper position, each conductor 64 is inserted into its respective hole 72 as shown in FIG. 5. An advantage to molding hinging load bar 60 in an open orientation is that holes 72 are much more accessible than if hinging load bar 60 was molded closed. This advantage can result in reduced assembly time and lower standard cost. Divider 56 is then positioned between the top and bottom rows of conductor pairs as shown in FIG. 6. Divider 56 is used to provide isolation between the top and bottom signal pairs. It also bonds to braid 68 of S/FTP cable 40 via collar 69 to carry the ground throughout GG45 plug 36. Divider 56 contains overlapping flanges 74 that reduce long gaps in coverage thereby providing a 360° bond around braid 68. Shear form barbs 76 are present to bite into the braid and cable jacket of S/FTP cable 40, providing the necessary strain relief to pass applicable strain relief testing. FIG. 7 shows hinging load bar 60 with its first half 65 and second half 67 closed about hinges 78. At this time, contacts 58 are mechanically crimped to a distance that is in accordance with IEC 6060377. The crimping operation can result in contacts 58 penetrating their respective conductor 64 such that contacts 58 make an electrical bond to the copper core of respective conductors 64.

Figure 8:
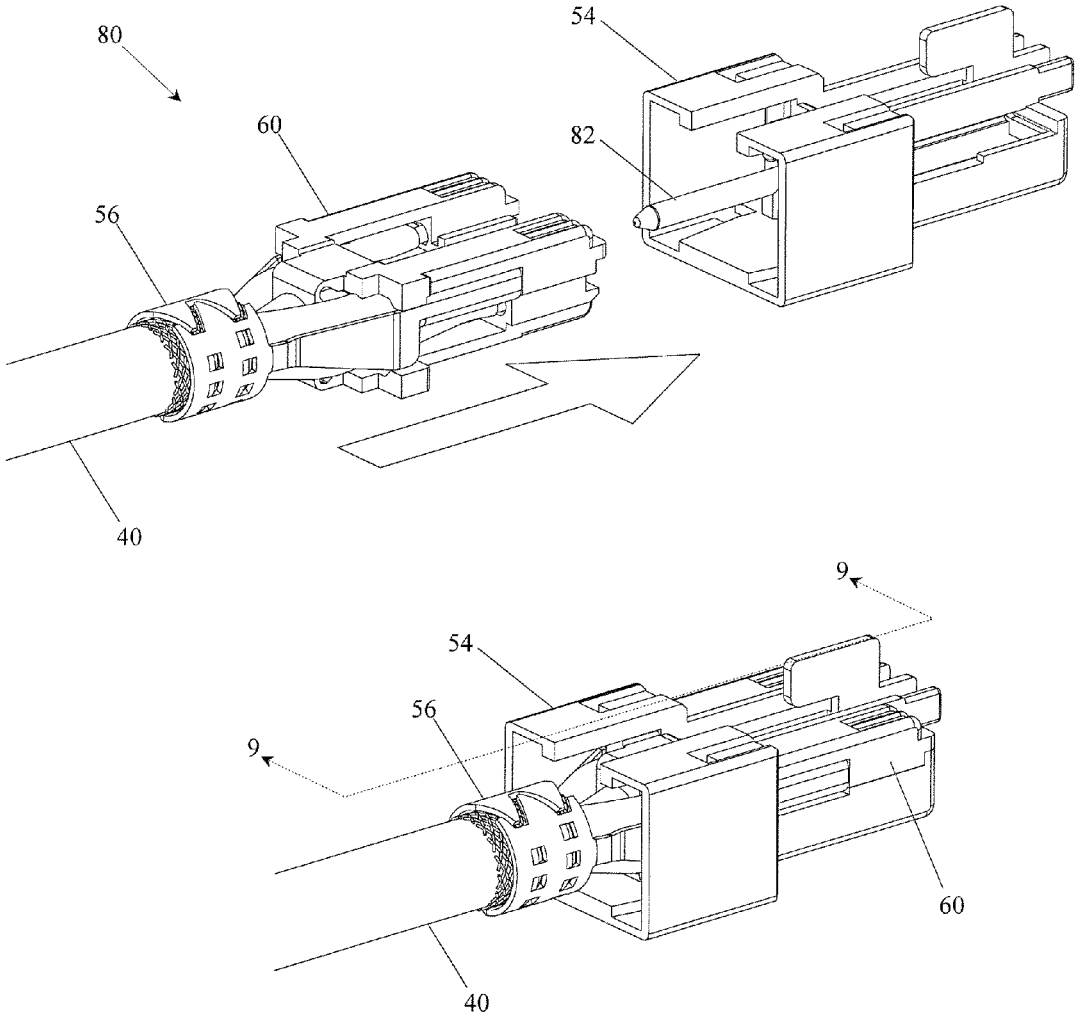
FIG. 8 are perspective views illustrating the subassembly of FIG. 7 being inserted into the plug housing of FIG. 2.
Figure 9:
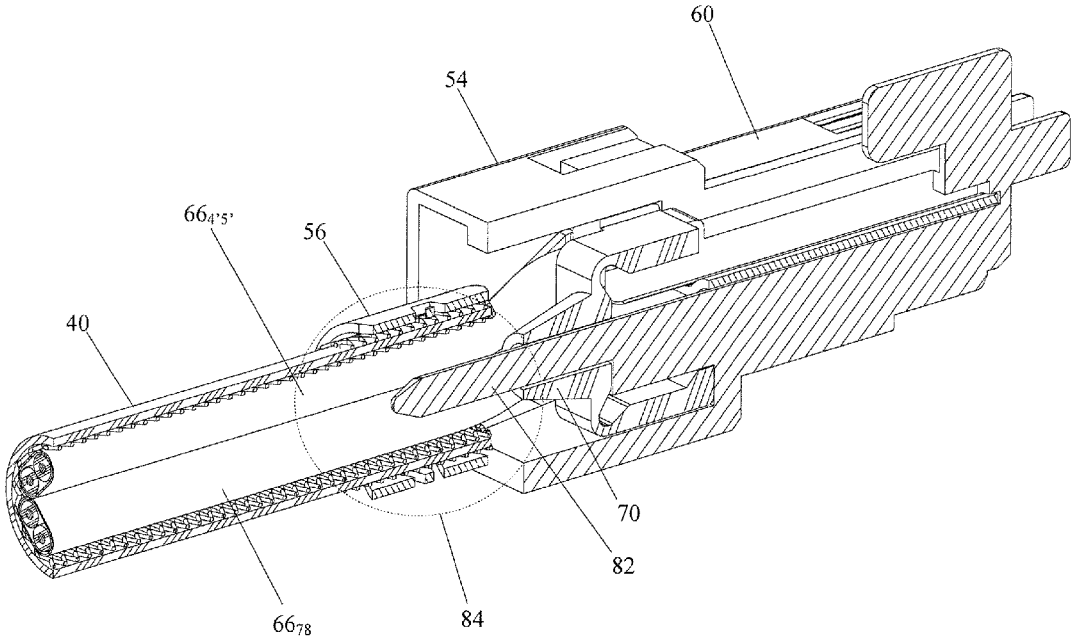
FIG. 9 is a crosssectional view taken along section line 9-9 in FIG. 8.

Subassembly 80 is inserted into metal plug housing 54 as shown in FIG. 8. This insertion electrically bonds divider 56 to plug housing 54, resulting in a continuation of the ground throughout the assembly. Post 82 of plug housing 54 goes through conical guide element 70 of hinging load bar 60 and touches all four conductor pair foils 66 as indicated in the FIG. 9 section view. Although foil 66 makes an electrical bond with divider 56, conductive post 82 of plug housing 54 also makes an electrical bond with foil 66, creating an additional bonding region and improving the overall robustness of the design. Additionally, post 82 provides mechanical support by pushing conductor pair foils 66 outwardly and reinforcing cable 40 to create rigidity in region 84. This outward force results in a higher pressure at the interface between cable 40 and shear form barbs 76 of metal divider 56, resulting in a more effective electrical bond as well as improved mechanical strain relief.

Figure 10:
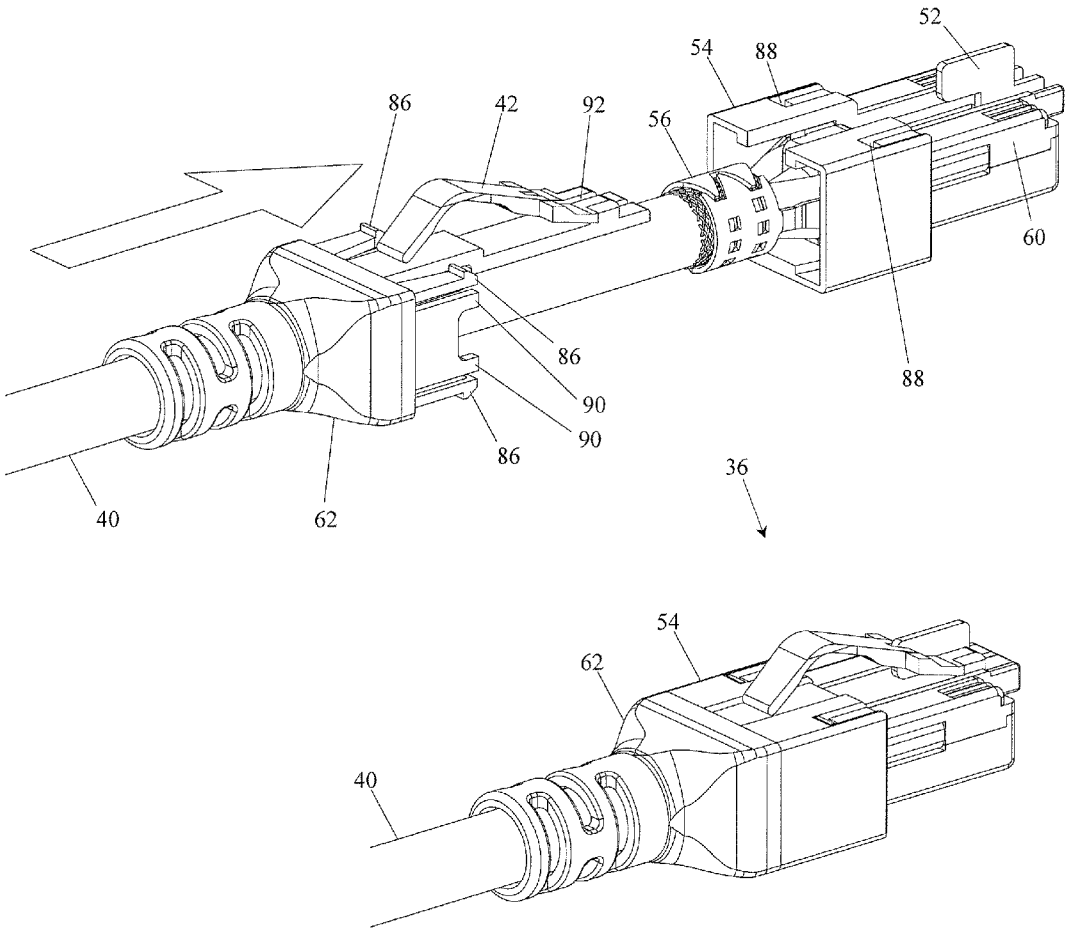
FIG. 10 are perspective views of the back housing of the plug of FIG. 2 being inserted into the subassembly of FIG. 8.
Figure 11:
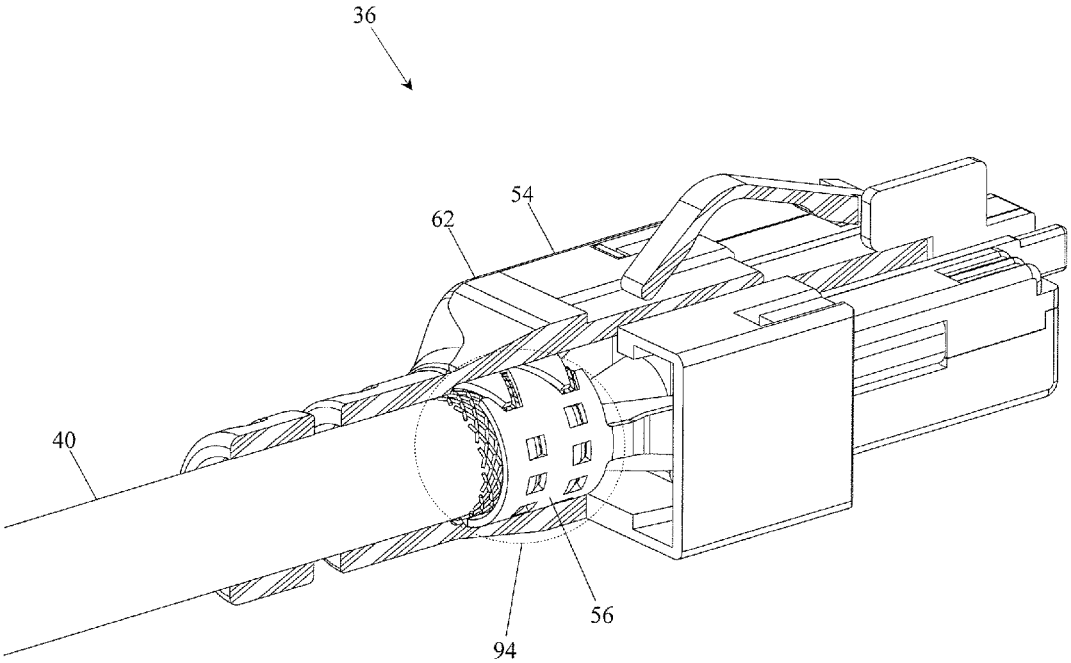
FIG. 11 is a perspective cutaway view of the GG45 plug of FIG. 2 showing the shear form barbs and overlapping flanges of the metal divider engaging the braid of the cable.

FIG. 10 shows that plastic back housing 62 then slides forward over cable 40, completing the assembly of GG45 plug 36. Four latches 86 from back housing 62 engage four pockets 88 from plug housing 54 to hold the assembly together. Rigid pads 90 from back housing 62 drive load bar 60 to the front of plug housing 54 and prevents load bar 60 from backing out. Dividing wall 52 of plug housing 54 fits within slot 92 of back housing 62. Dividing wall 52 also constrains release latch 42 and prevents it from buckling or moving out of position. When fully assembled, back housing 62 applies uniform compression to rear region 94 of divider 56 as shown in FIG. 11. The inward pressure from back housing 62, coupled with the outward pressure from post 82 of plug housing 54, creates a pressured interface between divider 56 and cable 40 resulting in a reliable electrical bond as well as the necessary mechanical strain relief Although communication system 30 is illustrated a patch panel in FIG. 1, alternatively it can he other active or passive equipment. Examples of passive equipment can be, but are not limited to, modular patch panels, punchdown-patch panels, coupler patch panels, wall jacks, etc. Examples of active equipment can be, but are not limited to, Ethernet switches, routers, servers, physical layer management systems, and poweroverEthernet equipment as can be found in data centers and or telecommunications rooms; security devices (cameras and other sensors, etc.) and door access equipment; and telephones, computers, fax machines, printers and other peripherals as can be found in workstation areas. Communication system 30 can further include cabinets, racks, cable management and overhead routing systems, and other such equipment. Cables 34 can be used in a variety of structured cabling applications including patch cords, zone cords, backbone cabling, and horizontal cabling, although the present invention is not limited to such applications. In general, the present invention can be used in military, industrial, telecommunications, computer, data communications, marine and other cabling applications.

While particular embodiments and applications of the present invention have been illustrated and described, it is to be understood that the invention is not limited to the precise construction and compositions disclosed herein and that various modifications, changes, and variations may be apparent from the foregoing without departing from the spirit and scope of the invention as described.

I claim:

1. A housing for use with a communication connector having at least four connector contacts arranged in a planar array, said communication connector terminated to a communication cable having a plurality of wire pairs, each of said at least four connector contacts connected to a respective wire of said plurality of wire pairs, said housing comprising:

an interior region; and a post positioned at least partially within said interior region, said post being an integrally formed part of said housing and extending in a longitudinal direction of said housing, said post configured to physically interact with each of said plurality of wire pairs.

2. The housing of claim 1, wherein said post includes a tapered end.

3. The housing of claim 1, wherein said physical interaction includes an outward pushing of said wire pairs.

4. A communication connector for use with a communication cable having a plurality of wire pairs, said communication connector comprising:

a plug housing having an interior region and a post positioned at least partially within said interior region, said post extending in a longitudinal direction of said plug housing; and a collar positioned at least partially over said communication cable, said collar being rigidly connected to a conductor divider, said conductor divider separating said plurality of wire pairs at least into a first subset of wire pairs and a second subset of wire pairs, wherein said post is configured to push each of said plurality of wire pairs against said collar.

5. The communication connector of claim 4, wherein said collar includes a plurality of barbs configured to bite into said communication cable.

6. The communication connector of claim 4, wherein each of said plurality of wire pairs is covered with conductive foil, wherein said plug housing is conductive, and wherein said plug housing establishes an electrical bond with each of said conductive foils via said post.

7. The communication connector of claim 4 further comprising a load bar positioned at least partially within said plug housing, said load bar having a guide with an aperture for receiving said post.

8. The communication connector of claim 7, wherein said guide at least one of guides said plurality of wire pairs around said load bar, guides said load bar towards a center of said communication cable, and guides said post towards said center of said communication cable.

9. The communication connector of claim 8, where said guide is a conical guide.

10. The communication connector of claim 4 further comprising a back housing attached to a rear end of said plug housing, said back housing providing uniform compression to at least a portion of said collar.

11. The communication connector of claim 4, wherein said plug housing includes a dividing wall configured to reduce crosstalk between at least some of said plurality of wire pairs.

12. The communication connector of claim 11 further comprising a back housing attached to a rear end of said plug housing, wherein said back housing includes a slot for receiving said dividing wall.

13. The communication connector of claim 4, further comprising:

a load bar for receiving said plurality of wire pairs; and a back housing attached to a rear end of said plug housing, said back housing having rigid pads for pushing said load bar towards a front of said plug housing.

14. A communication cable comprising:

a plurality of wire pairs, each of said plurality of wire pairs being covered with conductive foil; and a communication connector, said communication connector including:

at least four connector contacts arranged in a planar array, each of said at least four connector contacts connected to a respective wire of said plurality of wire pairs;

a plug housing having an interior region and a conductive post positioned at least partially within said interior region, said plug housing being conductive, said post extending in a longitudinal direction of said plug housing; and a collar positioned at least partially over said communication cable, wherein said post is configured to push each of said plurality of wire pairs against said collar, and establish an electrical bond between said plug housing and each of said conductive foils.

15. The communication cable of claim 14, wherein said collar includes a plurality of barbs configured to bite into said communication cable.

16. The communication cable of claim 14, wherein said collar is rigidly connected to a conductor divider, said conductor divider separating said plurality of wire pairs into a first subset of wire pairs and a second subset of wire pairs.

17. The communication cable of claim 14, wherein said communication connector further includes a load bar positioned at least partially within said plug housing, said load bar having a guide with an aperture for receiving said post.

18. The communication cable of claim 17, wherein said guide at least one of guides said plurality of wire pairs around said load bar, guides said load bar towards a center of said communication cable, and guides said post towards said center of said communication cable.

19. The communication cable of claim 14, wherein said communication connector further includes a back housing attached to a rear end of said plug housing, said back housing providing uniform compression to at least a portion of said collar.

20. A communication cable comprising:

a plurality of wire pairs; and a communication connector, said communication connector including:

a conductor divider, said conductor divider separating said plurality of wire pairs at least into a first subset of wire pairs and a second subset of wire pairs;

a collar positioned at least partially over said plurality of wire pairs, said collar being rigidly connected to said conductor divider; and a post at least partially enclosed by said collar, said post pushing each of said plurality of wire pairs against said collar.

21. The communication cable of claim 20 further comprising a cable jacket positioned at least partially over said plurality of wire pairs, wherein said collar is positioned at least partially over said cable jacket.

22. The communication cable of claim 21, wherein said collar includes a plurality of barbs configured to bite into said cable jacket, and wherein a force provided by said pushing of said plurality of wire pairs against said collar provides strain relief in a region where said communication connector is secured to said communication cable.

23. The communication cable of claim 20, wherein said post is tapered at one end.

24. The communication cable of claim 20, wherein said post is attached to a housing of said communication connector.

25. A communication connector for use with a communication cable having a plurality of wire pairs, said communication connector comprising:

a plug housing having an interior region and a post positioned at least partially within said interior region, said post extending in a longitudinal direction of said plug housing;

a collar positioned at least partially over said communication cable; and a load bar positioned at least partially within said plug housing, said load bar having a guide with an aperture for receiving said post, wherein said post is configured to push each of said plurality of wire pairs against said collar.

26. A communication connector for use with a communication cable having a plurality of wire pairs, said communication connector comprising:

a plug housing having a dividing wall configured to reduce crosstalk between at least some of said plurality of wire pairs, an interior region, and a post positioned at least partially within said interior region, said post extending in a longitudinal direction of said plug housing;

a collar positioned at least partially over said communication cable, wherein said post is configured to push each of said plurality of wire pairs against said collar.

27. A communication connector for use with a communication cable having a plurality of wire pairs, said communication connector comprising:

a plug housing having an interior region and a post positioned at least partially within said interior region, said post extending in a longitudinal direction of said plug housing;

a collar positioned at least partially over said communication cable;

a load bar for receiving said plurality of wire pairs; and a back housing attached to a rear end of said plug housing, said back housing having rigid pads for pushing said load bar towards a front of said plug housing, wherein said post is configured to push each of said plurality of wire pairs against said collar.

* * * * *